US006371197B2

(12) United States Patent
Weyer et al.

(10) Patent No.: US 6,371,197 B2
(45) Date of Patent: Apr. 16, 2002

(54) METHOD AND DEVICE FOR CASTING PREFABRICATED PRODUCTS IN A CONTINUOUS CASTING DEVICE

(75) Inventors: Axel Weyer, Wuppertal; Horst von Wyl, Duisburg, both of (DE)

(73) Assignee: SMS Demag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/784,318

(22) Filed: Feb. 14, 2001

(30) Foreign Application Priority Data

Feb. 19, 2000 (DE) ..... 100 07 706

(51) Int. Cl.[7] ..... B22D 11/20
(52) U.S. Cl. ..... 164/454; 164/484
(58) Field of Search ..... 164/454, 484, 164/413, 441, 442, 447, 448

(56) References Cited

U.S. PATENT DOCUMENTS 5,348,074 A * 9/1994 Streubel ..... 164/454
5,433,265 A * 7/1995 Rahmfeld et al. ..... 164/441
6,199,621 B1 * 3/2001 Weyer et al. ..... 164/484

FOREIGN PATENT DOCUMENTS

| | | |
|---|---|---|
| DE | 1963146 | 8/1973 |
| DE | 4306853 | 3/1996 |
| EP | 0908256 | 4/1999 |

* cited by examiner

*Primary Examiner*—Nam Nguyen
*Assistant Examiner*—I.-H. Lin
(74) *Attorney, Agent, or Firm*—Friedrich Kueffner

(57) ABSTRACT

In a method for casting prefabricated products in a continuous casting device, having a casting mold and a strand guide downstream of the casting mold, wherein the strand guide has rolls positioned opposite one another in pairs for supporting and guiding the solidifying cast strand. The motor torques of the drives are maintained at a level as equal as possible below a permissible torque limit value relative to a loadability of the strand shell. For a single drive and corresponding drive roll the permissible torque limit value is measured by continuously increasing the drive torque starting at zero and monitoring the rotational speed of the drive roll, while the remaining drive rolls are controlled to a preset nominal casting speed. For a superproportional increase of the rotational speed, the torque limit value is determined and the process is stopped.

7 Claims, 5 Drawing Sheets

METHOD AND DEVICE FOR CASTING PREFABRICATED PRODUCTS IN A CONTINUOUS CASTING DEVICE

BACKGROUND OF THE INVENTION

1. Field of the Invention

The invention relates to a method for casting prefabricated products, in particular, of steel materials such as slabs, blooms, beam blanks etc., in a strand casting device comprising a strand guide arranged downstream of the casting mold and optionally divided into segments, wherein the strand guide is comprised of pairs of oppositely arranged rolls for supporting and conveying the solidifying cast strand, wherein at least one of these rolls is forced by means of a drive, the drive roll, with a defined adjusting force, in interaction with idle rolls, against the cast strand for transmitting the guiding forces as well as strand conveying forces. The invention also relates to a device for performing the method.

2. Description of the Related Art

In continuous strand casting devices, preferably for steel materials and for manufacturing slabs, inter alia thin slabs, blooms, or beam blanks, the produced strands are supported and guided from the casting mold to at least the point of complete solidification by means of a roll guide. Individual rolls within this strand guide or downstream thereof are driven for overcoming the removal resistance to which the strand is subjected on its way through the roll guide device. The power of these drives is usually dimensioned such that, on the one hand, for any conceivable operational situation a safe conveying of the strand out of the device is ensured and, on the other hand, the manufacturing costs are as low as possible, and, moreover, the drives are not unnecessarily oversized.

The rolls of a strand guiding stretch of the strand casting device are subjected to continuous wear. Often it is observed that the driven rolls wear more strongly than the idle rolls. As a result of this, the roll diameter will change gradually. This causes diameter differences between the idle rolls and the driven rolls which are subjected to greater wear; however, the differences are not easily recognizable.

For ensuring a frictional connection between the driven rolls and a strand, it is known to use hydraulically or mechanically adjustable lifting traversing slides. Often, in particular, for avoiding quality reduction of the cast end product, they are loaded with a force which is below the force that can be produced by the strand itself as a result of its hydraulic height (ferrostatic pressure). This is designed to prevent strand deformations. However, in many cases the driven rolls are rigidly connected and integrated in a support frame.

With the wear of the driven rolls being faster in comparison to the idle rolls, after a longer or shorter operating time, a gradual loss of transmittable removal forces acting on the strand will occur which is generally not recognizable. Such a loss of transmittable removal force is limited by adjusting drive rolls by means of the applied adjusting force; however, in the case of rigidly arranged drive rolls the loss can cancel the entire transmittable tangential force. When such a creeping change of the removal force coincides with a critical casting situation relative to the removal resistance, the strand may get stuck in the casting device and this can cause a greater disruption.

In order to transmit the physically greatest possible traction force of the driven rolls onto the strand for the purpose of avoiding such disruptions, it has been suggested in this connection, for example, to expand the drive control by means of a traction control, processing simultaneously the drive torque and the rotational speed, in a so-called anti-lock system. Such a development known from the prior art is able to completely use the physical limit of the traction force defined momentarily by the material pair and the coefficient of friction. However, it cannot prevent falling below the adhesion limit, for example, resulting from a diameter loss that is too great and thus traction loss, even if, for example, by empirically determined operating experiments, the adhesion limit were known.

European patent document EP 0 908 256 A1 describes a method and a device for producing slabs in a strand casting device which has a strand guide arranged downstream of the casting mold and divided into two-part segments, wherein the casting strand is conveyed from the vertical casting direction into the horizontal rolling direction and is supported during the deflection and transport. The adjusting forces required for transmitting the conveying forces for the drive rolls are generally provided by hydraulic cylinders. In this connection, it is proposed to replace the hydraulic clamping cylinders, which clamp the two segment frame parts against one another via spacers, by segment adjusting cylinders so that the adjusting forces for the drive rolls are displaced toward the segment intake or segment exit and the forces for strand conveying are supplied also by the segment adjusting cylinders.

For strand guiding frames of a segment configuration, as described in an arc device disclosed, for example, in German patent document DE 1963 146 C1, which guides the cast strand from the vertical casting direction into the horizontal rolling direction, the upper and lower frames of the segments are clamped against one another by four hydraulic cylinders that connect the frames and are arranged on the corners external to the casting strand. The adjustment of different strand thicknesses is realized by spacers against which the frame parts are pressed. A change of the roll spacing during the casting process is not possible in this configuration.

In the German patent document DE 43 06 853 C2 it is suggested to arrange between the spacers and the respective lateral frame part a hydraulic plunger cylinder and to dimension its annular piston such that in the pressure-relieved state it secures the segment parts at the spacing of the rolls which corresponds to the desired strand thickness. By this measure, an adjustment of the guide roll to different strand thicknesses is possible, but this configuration requires that at least one of the rolls, the drive roll, is pressed by its own hydraulic adjusting cylinders (at least two per drive roll) with the required adjusting force for the transmission of the strand conveying forces against the cast strand.

SUMMARY OF THE INVENTION

It is an object of the present invention to improve the guiding of the cast strand, preferably from the vertical casting direction into the horizontal rolling direction, such that a gradual wear resulting on the rolls during the course of operation and entailing a loss of transmittable removal force can be anticipated in order to prevent by a timely initiation of preventive maintenance an operational failure, for example, preventing the strand from becoming stuck in the casting device.

In accordance with the present invention, this is achieved in that all drives are controlled to have a predetermined rotational speed such that their circumferential roll speeds are identical within the limits of a preset casting speed and the correlated motoric torques (engine torque) are maintained, with respect to the loadability of the strand shell, to a level as equal as possible below a permissible torque limit value and that, for determining the permissible torque limit values, first on a single drive of the device, while all other drives are controlled accordingly to the aforementioned nominal casting speed, the drive torque, beginning at zero, is gradually increased and, in this connection, the rotational speed of the drive roll is monitored and, in the case of a superproportional rotational speed increase A, the torque limit value B is determined and the process stopped.

With an expedient configuration of the method according to the invention it is proposed that the torque limit value B with corresponding rotational speed (slip torque and slip speed), measured immediately before the rotational speed increase A, taking into consideration boundary parameters such as the steel quality, the casting speed, the casting shape, the spraying pattern etc. with respect to the measured roll is stored in a memory for later processing.

A further development of the method according to the invention is that the measurement of the rotational speed limit value A as well as the torque limit value B and their storage is performed successively for all driven rolls of the device and the measurements are performed either manually or according to a program, wherein the measurements are sequentially repeated and performed at least once after sufficiently long running-in time of the device with lowered casting speed on a solidified area of the casting strand.

Moreover, it is provided with the method according to the invention that the aforementioned measurements are carried out in each sequence, i.e., between beginning of casting and end of casting, or once for a preset time frame, respectively, the longest however being a monthly interval.

Finally, one embodiment of the method according to the invention proposes that the measured stored data are entered into a processing module which correlates the determined parameters for slip torque and slip rotational speed, including the casting boundary conditions, linearly or squarely, for example, according to the method of the least squares, and a trend curve, which is determined thereby, is compared to a curve for the adhesion limit, based on experiments or theoretical considerations, wherein the trend curve and the limit curve Y are intercepted with one another and the point of interception defines the remaining time until reaching the functional limit of the drive rolls, and wherein planned operating programs such as maintenance times etc. are taken into consideration. This increases the forecasting precision when an approach as closely as possible to the permissible limit is reached and processing is performed preferably in a processing unit of the device with automated data transmission.

As can be seen from the method according to the invention, the basis of the invention is the rotational speed control of a strand guide of the aforementioned configuration with underlying torque control (load compensation control), wherein primarily all drives are controlled to a rotational speed such that their circumferential roll speeds are identical within permissible limits, that, however, at the same time also the motor currents (motor torques) are maintained at a same level as much as possible relative to the loadability of the strand shell within the device.

With the method according to the invention the following control for the roll drives can be performed:

1. While all other roll drives are controlled according to the actually adjusted nominal casting speed and a nominal torque, the drive torque is gradually increased for an individual roll drive of the device, starting at zero. In this connection, the rotational speed of the drive roll is permanently monitored and the process is stopped as soon as a torque has been reached at which suddenly, or superproportionally, the rotational speed changes.
2. The torque limit value and the corresponding rotational speed (slip torque and slip rotational speed), measured immediately before the abrupt rotational speed change, are stored with consideration of momentary boundary conditions such as steel quality, casting width and casting thickness, spraying pattern and/or casting speed with respect to the roll currently being measured as well as with respect to the roll segment of the roll currently being measured in a long-term memory for access and processing at a later point in time.
3. The measures defined under items 1. and 2. are performed successively for all driven rolls of the casting machine. These measurements are performed manually or according to program.
4. The measures mentioned under items 1. to 3. are repeated sequentially, at least once, however, in stationary casting operation, after a sufficiently long running-in time of the casting device, at lowered casting speed, wherein it is to be ensured that the roll employed for a measurement, respectively, runs on a completely solidified area of the cast strand.
5. The measures named under items 1. to 4. are performed regularly, for example, in each sequence, between a new beginning of casting and end of casting or once within a reference time period, at the longest at a monthly spacing.
6. The measured and stored data are correlated in an evaluation module with the boundary condition parameters recorded during the preceding measurements, wherein a trend curve for rotational speed and slip is intercepted with a limit curve wherein the points of interception identify the expected time before reaching the functional limit of the drive rolls.

A device for casting pre-fabricated products, in particular, of steel materials such as slabs, blooms, beam blanks etc., for performing the method according to the invention comprises means for storing and transmitting measured data, in particular, of the driven rolls and optionally of the segments correlated therewith to a data acquisition system of the device. According to the invention, it is proposed that the data acquisition system comprises an algorithm unit for correlating the average wear of idle rolls with that of the driven rolls, wherein the algorithm unit is connected in a data-technological way with an information unit for operational data, for example, from operating experiments or theoretical calculations based on the prior art.

Further developments of the invention can be taken from the dependent claims.

DESCRIPTION OF THE PREFERRED EMBODIMENTS

Figure 1:
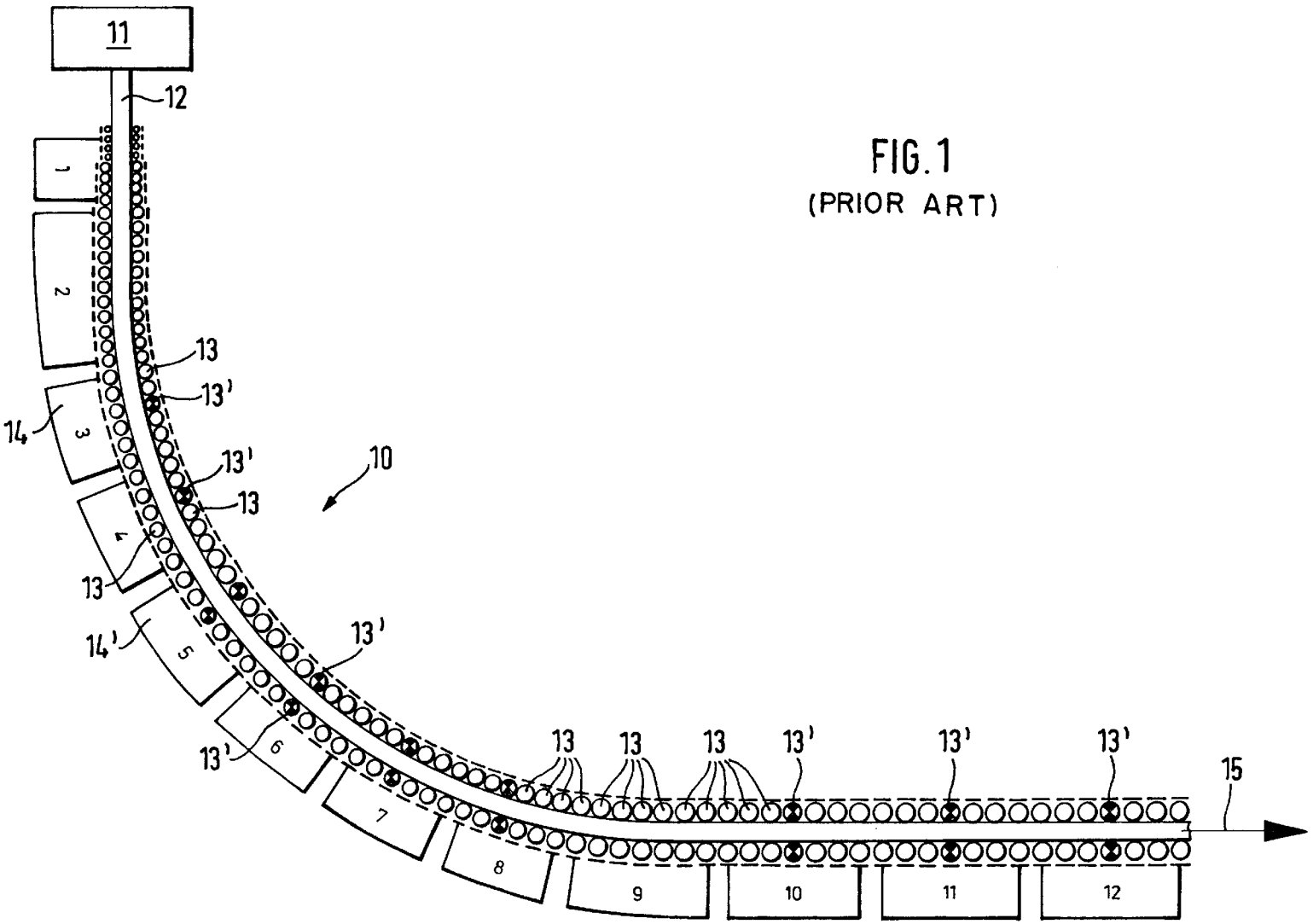
FIG. 1 (PRIOR ART)
FIG. 1 shows the strand guide of a strand casting device with roll segments according to the prior art.

FIG. 1 shows a strand guide 10 of a strand casting device, for example, for thin slabs, comprising a number of roll segments 14, 14' by which a cast strand 12 exiting from the casting mold 11 is guided by means of oppositely positioned rolls 13 in an arc shape out of the casting direction into the horizontal rolling direction 15 and is further conveyed by means of drive rolls 13'.

In some of these roll segments 14, 14' one of the rolls 13, for example, in the segments 3 and 4, is embodied as a drive roll 13' with drive means and arranged at the inner side of the arc of the strand guide 10. The roll segments 5 to 8 arranged downstream are provided in the center of the segment with two oppositely arranged drive rolls 13' which support the strand and convey it.

In the subsequently arranged outlet portion for the strand 12 the roll segments 10, 11, 12 are also provided with oppositely positioned driven roll pairs 13'.

Figure 2:
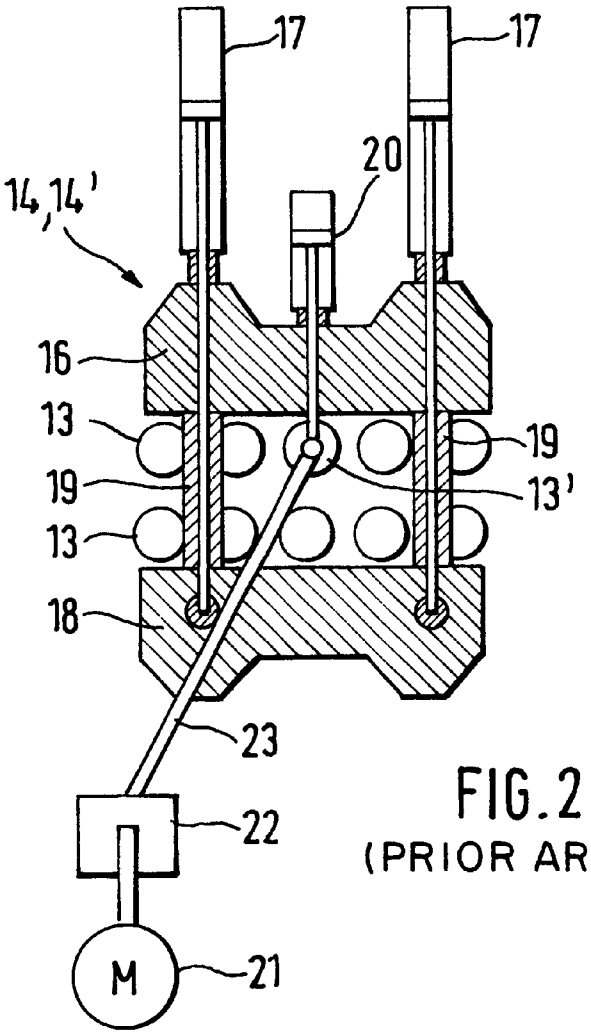
FIG. 2 (PRIOR ART)
FIG. 2 is a section of a roll segment according to the prior art with illustrated drive.

FIG. 2 shows a roll segment 14, 14' according to the prior art comprising a drive roll 13' driven by the motor 21 via the gearbox 22 and the drive shaft 23.

Figure 3:
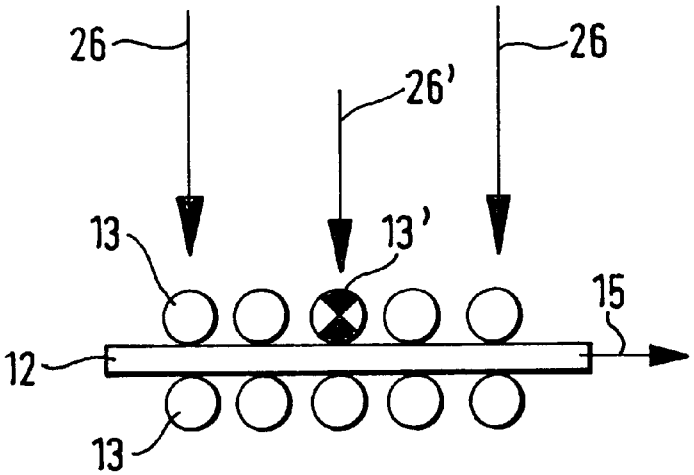
FIG. 3 (PRIOR ART)
FIG. 3 is a diagrammatic illustration of the forces to be applied onto a roll segment according to FIG. 2.

The roll segment 14, 14' is comprised of an upper segment frame 16 which is forced by means of hydraulic clamping cylinders 17 against the segment bottom frame 18. In this connection, spacers 19 are provided which provide a uniform spacing of the frame parts 16, 18 from one another. The drive roll 13' arranged in the center of the segment 14, 14' in the upper segment frame 16 applies the required strand conveying forces 26' onto the strand 12, as shown in the diagrammatic illustration in FIG. 3, while the other rolls 13 of the segment frames 16, 18 supply the required clamping forces 26 for clamping the segments so that the rolls 13, 13' supported in the segment frame parts 16, 18 fulfill their function as support and conveying members for transporting the cast strand 12 in the conveying direction 15.

Figure 5:
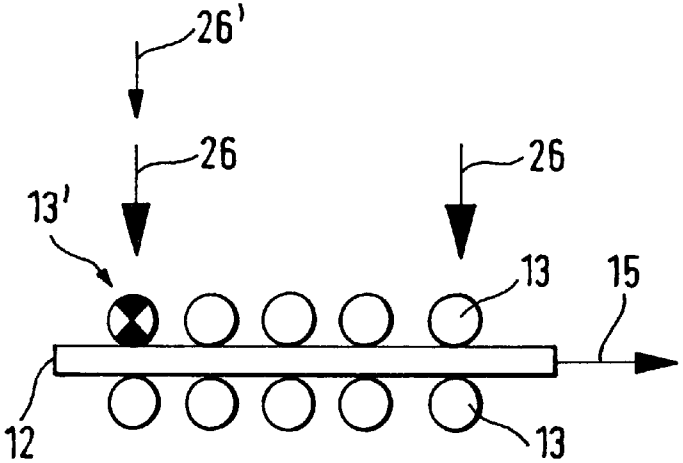
FIG. 5 (PRIOR ART)
FIG. 5 is a diagrammatic illustration of the forces to be applied onto a roll segment according to FIG. 4.
Figure 4:
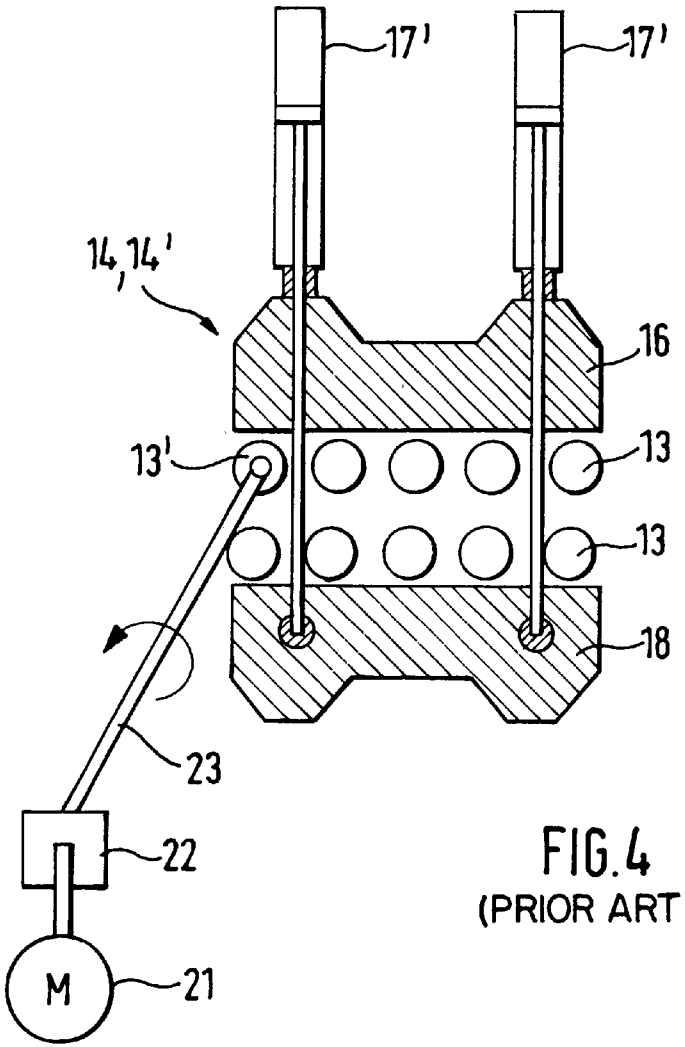
FIG. 4 (PRIOR ART)
FIG. 4 is a section of a roll segment with a drive roll integrated into the segment adjusting device with adjusting cylinders positioned at the ends.

FIGS. 4 and 5 show a segment 14, 14' also of a configuration according to the prior art.

Instead of the hydraulic clamping cylinders 17, used in the roll segments 14, 14' of FIG. 2 for clamping the segment frame parts 16, 18, wherein the cylinders 17 clamp the segment frame parts 16, 18 against one another with unchangeable spacing by acting against spacers 19, in the segment configuration according to FIG. 4 position-controlled and force-controlled segment adjusting cylinder 17' are provided for a controllable clamping of the segment frame parts 16, 18. In this configuration the drive roll 13' is arranged at the forward or at the rearward segment edge while with the aid of the position-controlled and force-controlled segment adjusting cylinders 17' the required adjusting force has been displaced toward the segment edge so that a separate adjusting cylinder for the drive roll 13', as shown in FIG. 2, is not required.

The resulting combination of adjusting forces and strand conveying forces 26, 26' can be seen in FIG. 5.

Figure 7:
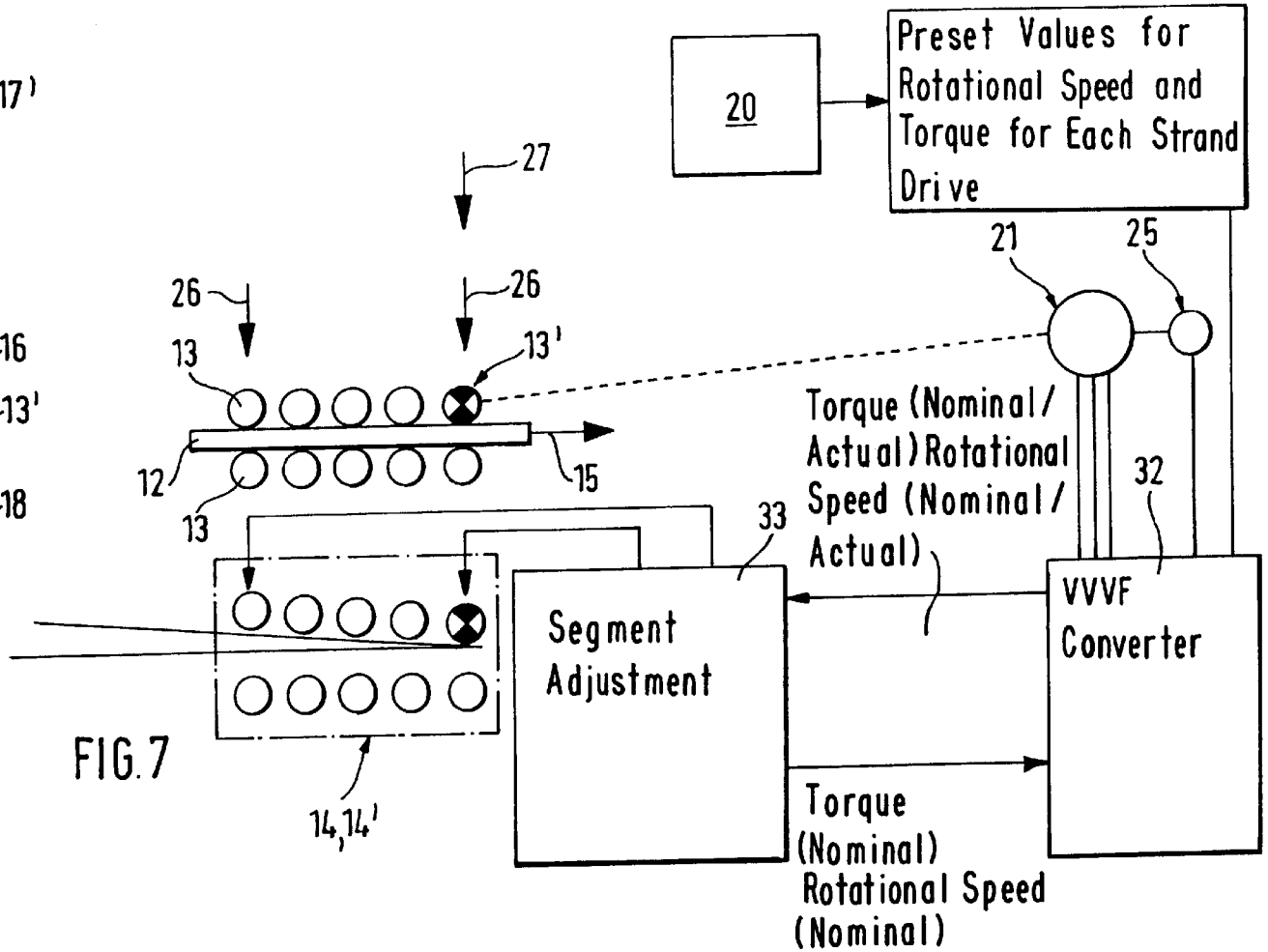
FIG. 7 is a diagrammatic illustration for determining the torque limit value with corresponding rotational speed (slip torque and slip rotational speed)
Figure 6:
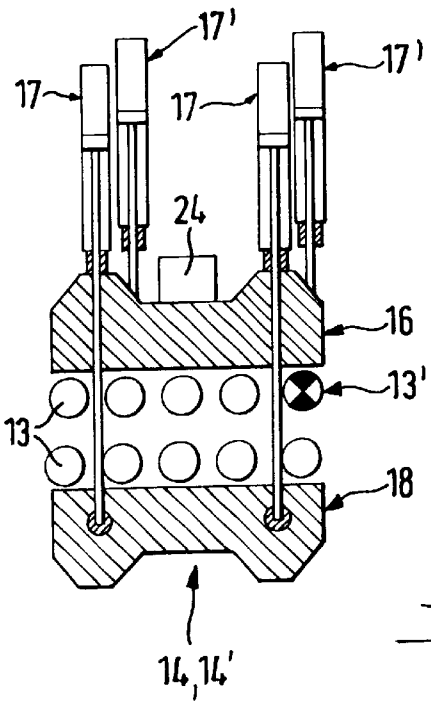
FIG. 6 is a sectional view of a roll segment according to the invention with integrated driven drive roll positioned at the end.
Figure 8:
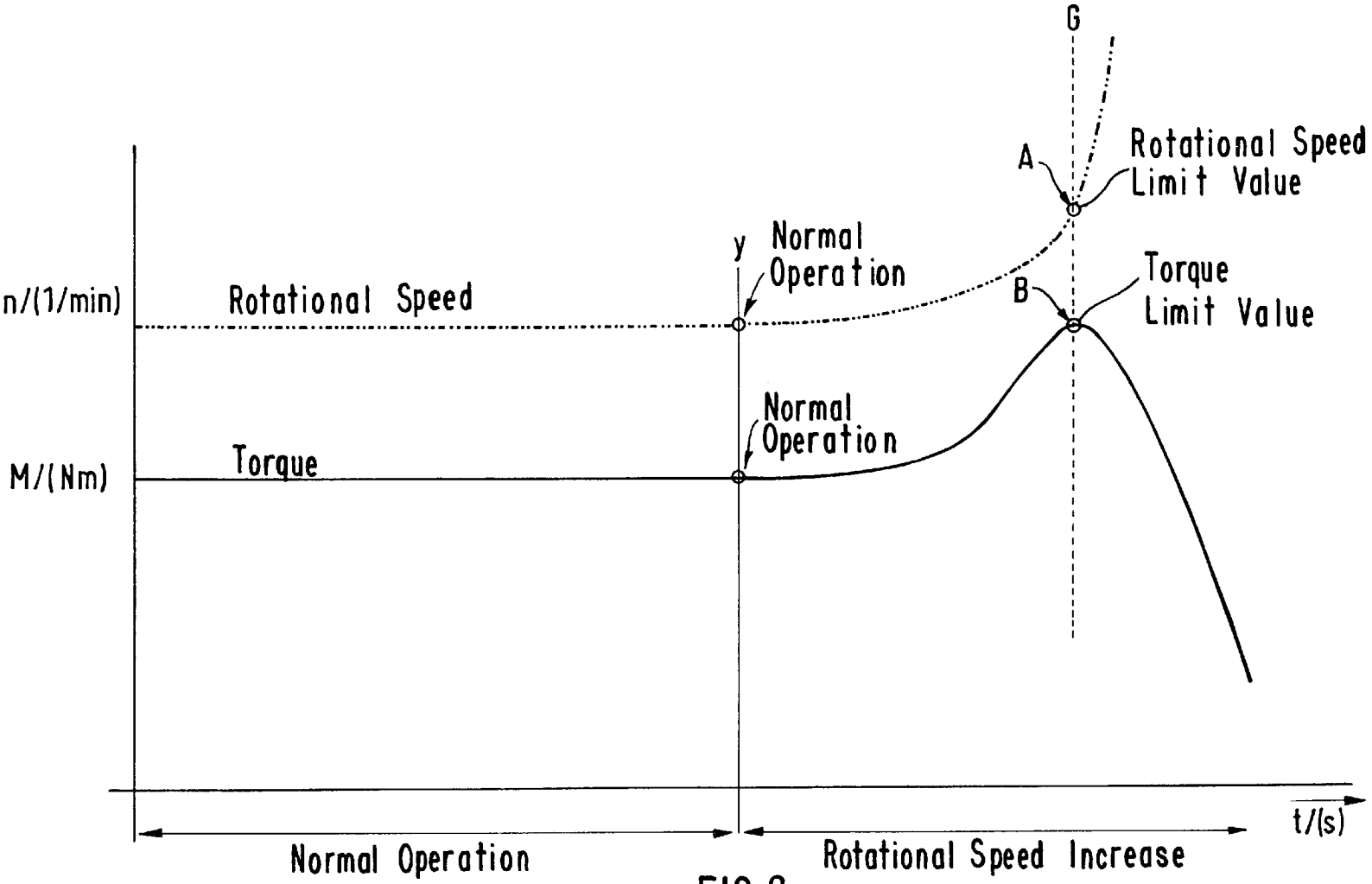
FIG. 8 is a diagrammatic illustration of the drive torque diagnosis according to the invention for normal operation or for rotational speed increase up to the rotational speed limit value or torque limit value.

A segment drive concept with integrated drive roll 13' and means for performing the invention can be taken from the combination of FIGS. 6 through 8. In this connection, the configuration of the roll segments 14, 14' with drive rolls 13' at the end corresponds in principle to the configuration of the roll segments 14, 14' of FIG. 4.

According to FIG. 7, while all other drives are controlled according to the nominal casting speed, the drive torque of the drive roll 13', for determining the torque limit value, is increased continuously in connection with the drive motor by increasing the strand conveying force 27, beginning at zero, so that also the torque which is transmitted onto the strand 12 increases continuously, also beginning at zero.

In this connection, the diagram or FIG. 8 first shows the normal operation at constant rotational speed and constant torque up to the end of the horizontal extension at the point of interception with the vertical line Y. For the then occurring increase, first occurring continuously, into an acceleration curve with approximately square increase, the point of interception A with the vertical line G is reached at the rotational speed limit value.

This rotational speed limit value is characterized in that the corresponding torque limit value, next to the point of interception B with the limit line G, drops superproportionally.

The method for determining the rotational speed limit value and the torque limit value and the working steps for this purpose are illustrated in FIG. 7.

This shows that the data acquisition system 20 of the device has a first computer 31 for presetting rotational speed and torque for each strand drive, in particular, with loading of a second computing unit 32, having means for a nominal/actual comparison of rotational speed and torque and coupled with the motor 21 via at least one drive roll 30', and in cooperation with a third computing unit 33 for controlling the required segment adjustment by the adjusting cylinders 17, 17', for the basic functions, i.e., adjusting 26 for temperature shrinkage and soft reduction of the roll segments 14, 14' as well as, according to arrow 27, for the additional functions such as slip diagnosis and maximization of the drive torque.

In this connection, the additional measure can be employed that the second competing unit 22 has a temperature sensor 25 connected thereto. Finally, each roll segment 14, 14' provided with a drive roll 13' for drive torque diagnosis can be provided with an individual data storage chip 24. The chips, for example, can be arranged on the upper segment frame 16 of the segments 14, 14' or at another location of the segment.

By means of the described invention it is possible:

- to avoid unpredictable transporting problems of the strand as a result of wear of the driven rolls,
- to eliminate a prophylactic exchange of rolls or support frames or segments entirely and to perform maintenance only when this is physically required or
- to adjust the production program to be cast to the actual removal forces;
- to collect long-term experiences with regard to wear history of the casting device and to thereby optimize:
  - on the one hand, the limit criteria required for the method and,
  - on the other hand, for example, also the employed roll materials or the operating program of the device;

to allow evaluation of the use of non-adjusted drive rolls for the operator and to thus make it safe and to thus lower the investment costs and the operating costs, to obtain for storage media correlated with the device at the same time further information about the life-cycle of the device and to thus schedule prophylactic maintenance with greater accuracy;

when using non-adjusted drive rolls, to make available the maximum possible drive output by changing the adjusting angle for short periods of time (in the case of removal problems). In this connection, the principle of the anti-slip control can be used additionally.

While specific embodiments of the invention have been shown and described in detail to illustrate the inventive principles, it will be understood that the invention may be embodied otherwise without departing from such principles.

What is claimed is:

1. A method for casting pre-fabricated products in a continuous casting device comprising a casting mold and a strand guide arranged downstream of the casting mold, wherein the strand guide is comprised of rolls positioned opposite one another in pairs for supporting and guiding the solidifying cast strand, wherein some of the rolls are drive rolls and some of the rolls are idle rolls, wherein drives are provided for the drive rolls and wherein the drive rolls are configured to be adjusted against the cast strand in order to transmit guiding forces and strand conveying forces onto the cast strand in interaction with the idle rolls, the method comprising the steps of:

controlling the drive rolls and the drives to a preset rotational speed such that the drive rolls have circumferential speeds identical to one another within limits of a preset casting speed, wherein motor torques of the drives corresponding to the limits of the preset casting speed are maintained at a level as equal as possible below a permissible torque limit value relative to a loadability of strand shell;

measuring for a single drive and corresponding drive roll the permissible torque limit value by continuously increasing drive torque starting at zero and monitoring rotational speed of the corresponding drive roll, while remaining drive rolls are controlled to a preset nominal casting speed; and wherein for a superproportional increase of the rotational speed the torque limit value is determined and the process is stopped.

2. The method according to claim 1, comprising the step of storing in a memory slip torque and rotational slip speed corresponding to a torque limit value, measured immediately before the rotational speed increase, and the corresponding rotational speed, taking into account casting parameters selected from the group consisting of steel quality.

3. The method according to claim 2, wherein the step of measuring and the step of storing are carried out for all drive rolls successively manually or program-controlled, wherein the step of measuring is repeated sequentially and at least once, after a sufficiently long running-in time, is carried out on a solidified area of the cast strand at a lowered casting speed.

4. The method according to claim 3, wherein the step of measuring is carried out in each sequence between beginning of casting and end of casting or once within a preset time frame.

5. The method according to claim 4, wherein the longest preset time frame is a month.

6. The method according to claim 2, further comprising the steps of:

entering the data stored in the memory into a processing unit;

correlating the slip torque and rotational slip speed and the casting parameters in the processing unit by a linear function or a square function and determining a trend curve;

comparing the trend curve with an adhesion limit curve determined experimentally or theoretically, wherein the trend curve and the limit curve are intercepted and wherein the points of interception define the remaining time before reaching a functional limit of the drive rolls, wherein planned operational programs and servicing intervals are taken into consideration.

7. The method according to claim 6, wherein in the step of correlating the method of least squares is used.

* * * * *